US011191985B2

(12) United States Patent
Huotari

(10) Patent No.: US 11,191,985 B2
(45) Date of Patent: Dec. 7, 2021

(54) WATER MIST NOZZLE FOR A FIRE SUPPRESSION SYSTEM

(71) Applicant: Marioff Corporation Oy, Vantaa (FI)

(72) Inventor: Arto Huotari, Helsinki (FI)

(73) Assignee: MARIOFF CORPORATION OY, Vantaa (FI)

( * ) Notice: Subject to any disclaimer, the term of this patent is extended or adjusted under 35 U.S.C. 154(b) by 153 days.

(21) Appl. No.: 16/060,349

(22) PCT Filed: Dec. 10, 2015

(86) PCT No.: PCT/EP2015/079255
§ 371 (c)(1),
(2) Date: Jun. 7, 2018

(87) PCT Pub. No.: WO2017/097361
PCT Pub. Date: Jun. 15, 2017

(65) Prior Publication Data

US 2018/0361181 A1 Dec. 20, 2018

(51) Int. Cl.
*A62C 31/02* (2006.01)
*A62C 37/11* (2006.01)
(Continued)

(52) U.S. Cl.
CPC ..... *A62C 31/02* (2013.01); *A62C 35/68* (2013.01); *A62C 37/11* (2013.01); *A62C 99/0072* (2013.01); *B05B 1/265* (2013.01)

(58) Field of Classification Search
CPC ..... B05B 1/265; B05B 1/262; B05B 1/267; A62C 31/02; A62C 37/11; A62C 35/68; A62C 99/0072
See application file for complete search history.

(56) References Cited

U.S. PATENT DOCUMENTS 2,135,138 A * 11/1938 Horace ..... B05B 1/265 239/498
3,008,652 A * 11/1961 McLean ..... B05B 1/3405 239/439
(Continued)

FOREIGN PATENT DOCUMENTS

DE 8526684 U1 12/1985
DE 3533258 A1 * 3/1987 ..... B05B 1/265
(Continued)

OTHER PUBLICATIONS

International Search Report and Written Opinion for application PCT/EP2015/079255, dated Aug. 25, 2016, 13 pages.

*Primary Examiner* — Tuongminh N Pham
(74) *Attorney, Agent, or Firm* — Cantor Colburn LLP

(57) ABSTRACT

A water mist nozzle (2) for a fire suppression system comprises a nozzle head (4) including a discharge nozzle (6) for supplying a fluid jet (12); a support structure (8); and a stationary deflector element (10). The stationary deflector element (10) is fastened to the support structure (8) and comprises a body with a substantially round outer periphery having a base portion (28) and a substantially conical upper portion (22) with a central peak (24). The substantially conical upper portion (22) provides a plurality of flowpaths (26), the flowpaths (26) extending substantially radially from a radial position close to the central peak (24) in a direction towards the outer periphery, the flowpaths (26) having at least one portion (26*a*, 26*b*, 26*c*) of decreasing slope, in which the slope of the bottom of the flowpaths (26) decreases along the flow direction towards the outer periphery. The stationary deflector element (10) is fastened to the support structure (8) such that the central peak (24) of the substantially conical upper portion (22) of the stationary deflector element (10) faces the discharge nozzle (6) and that the fluid jet (12) exiting the discharge nozzle (6) impinges
(Continued)

Figure 1:
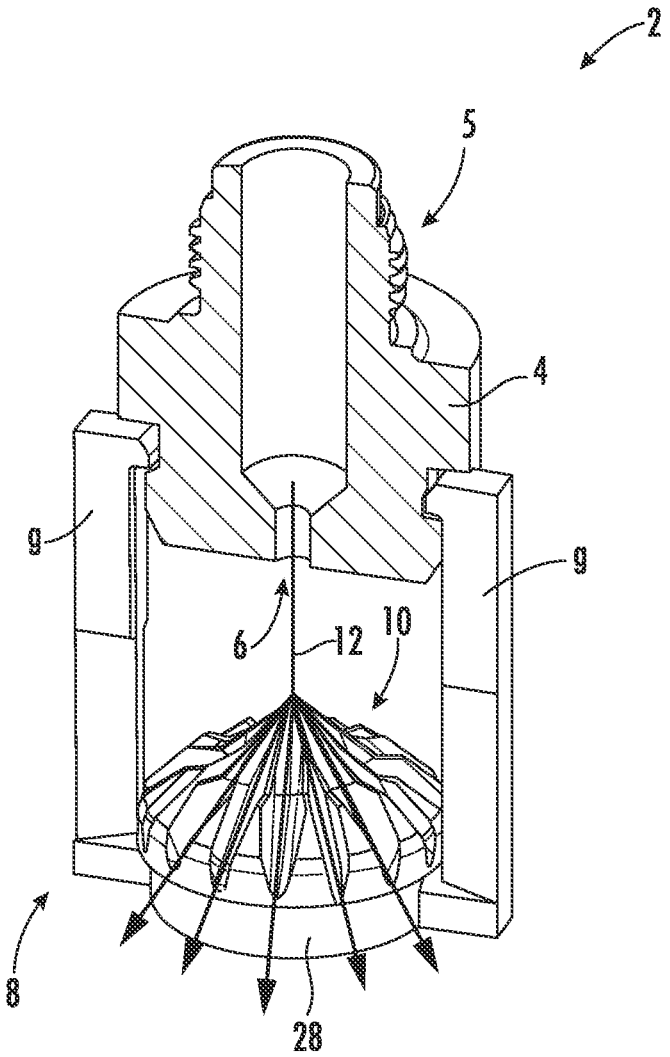

onto the central peak (24) and is distributed to the environment, substantially in a lateral direction, through the plurality of flowpaths (26).

20 Claims, 4 Drawing Sheets

(51) Int. Cl.

| | |
|---|---|
| ***B05B 1/26*** | (2006.01) |
| ***A62C 99/00*** | (2010.01) |
| ***A62C 35/68*** | (2006.01) |

(56) References Cited

U.S. PATENT DOCUMENTS

| | | | | |
|---|---|---|---|---|
| 3,178,119 | A | 4/1965 | Thorson | |
| 5,366,022 | A | 11/1994 | Meyer et al. | |
| 5,829,684 | A | 11/1998 | Fischer | |
| 5,839,667 | A | 11/1998 | Fischer | |
| 5,865,256 | A | 2/1999 | Pounder | |
| 6,082,465 | A | 7/2000 | Retzloff | |
| 6,276,460 | B1 | 8/2001 | Pahila | |
| 6,446,732 | B1 | 9/2002 | Polan | |
| 6,854,668 | B2 | 2/2005 | Wancho et al. | |
| 7,275,603 | B2 | 10/2007 | Polan | |
| 7,314,093 | B2 | 1/2008 | Orr | |
| 8,074,725 | B2 | 12/2011 | Rogers et al. | |
| 9,132,305 | B2 | 9/2015 | Feenstra | |
| 2001/0054508 | A1 | 12/2001 | Fischer et al. | |
| 2005/0011652 | A1* | 1/2005 | Hua | A62C 31/05 169/37 |
| 2008/0017732 | A1 | 1/2008 | Perkins et al. | |
| 2011/0315406 | A1* | 12/2011 | Connery | A62C 99/0072 169/16 |

FOREIGN PATENT DOCUMENTS

| | | | |
|---|---|---|---|
| JP | 2012165801 | A | 9/2012 |
| JP | 5054997 | B2 | 10/2012 |
| WO | 2005107880 | A1 | 11/2005 |
| WO | 2014165268 | A2 | 10/2014 |

* cited by examiner

WATER MIST NOZZLE FOR A FIRE SUPPRESSION SYSTEM

The present invention relates to a water mist nozzle for a fire suppression system, in particular to a water mist nozzle with a deflector plate.

Water mist nozzles including spray heads and sprinklers, which are configured for generating a spray or water mist, are known to be used in fire suppression systems for distributing a fire-extinguishing fluid, in particular water, over the area of fire.

Sprinklers include a heat responsive element blocking the water flow, i.e. sprinklers have an integrated "valve". The "valve" may be just a plug or a more complex system. The heat responsive element reacts to a raise of ambient temperature. This reaction opens the "valve" and allows water flow from the sprinkler. In sprinkler systems normally the pipes connected with the sprinkler are filled up. The liquid within the pipes is pressurized and this pressure is used for moving the valve components.

Spray heads do not include such a heat responsive element or "valve" blocking the water flow. The pipes connected with the spray heads are dry, i.e. they are not filled with water. The system is activated based on external signal e.g. detection system or manual activation. When the system is activated, the pipes are filled with liquid, in particular water, which comes out from all of the spray heads simultaneously. In contrast, in sprinkler systems liquid emits only from the sprinklers in which the heat responsive element has been activated.

A typical water mist nozzle includes a base connected to the conduit and a nozzle head which is configured for dispensing the fluid to provide fire control and/or suppression.

It would be beneficial to provide an improved water mist nozzle for a fire suppression system, in particular a water mist nozzle dispensing the fluid more efficiently.

According to an exemplary embodiment of the invention, a water mist nozzle, which may be a spray head or a sprinkler and which is configured to be employed in a fire suppression system, comprises a nozzle head including a discharge nozzle for supplying a fluid jet, spray or water mist; a support structure; and a stationary deflector element which is fastened to the support structure. The stationary deflector element comprises a body having a base portion with a substantially round, in particular circular, outer periphery and a substantially conical upper portion which ends in a central peak. The substantially conical upper portion provides a plurality of flowpaths. The flowpaths extend substantially radially from a radial position close to the central peak towards the outer periphery. The flowpaths respectively include at least a portion of decreasing slope, in which the slope of the bottom of the flowpaths, when seen in the flow direction of the fluid, decreases towards the outer periphery, with the slope being measured with respect to a plane which is perpendicular to an axis extending between the discharge nozzle and the central peak. The stationary deflector element is fastened to the support structure such that the central peak of the substantially conical upper portion of the stationary deflector element faces the discharge nozzle and that the fluid jet exiting the discharge nozzle impinges onto the central peak and is distributed to the environment, substantially in a lateral direction, by the plurality of flowpaths.

Spray or water mist is generated after the fluid leaves the deflector plate. Additional break up may happen also right after the jet exits the discharge nozzle.

A deflector element according to exemplary embodiments of the invention minimizes energy losses, which would be caused by sharp bends, when deflecting the fluid flow. As there is only one orifice controlling the fluid jet from the discharge nozzle, the flow can be controlled with high accuracy. As a result, a deflector element according to exemplary embodiments of the invention causes a distribution of the fire-extinguishing fluid, which is very efficient for fire extinction. In particular, it allows to operate the fire suppression system with less fluid pressure than conventional water mist systems without reducing the distance between the water mist nozzles. Additionally, the amount of fire-extinguishing fluid needed for extinguishing the fire is reduced.

As most internal components, which are present in a conventional water mist sprinkler, may be eliminated and there are no moving, in particular sliding, parts, exemplary embodiments of the invention further allow for a very reliable and cheap nozzle construction.

In the following exemplary embodiments of the invention will be described with reference to the enclosed figures:

FIG. 1 depicts a perspective sectional view of the water mist nozzle according to an exemplary embodiment of the invention.

Figure 2A:
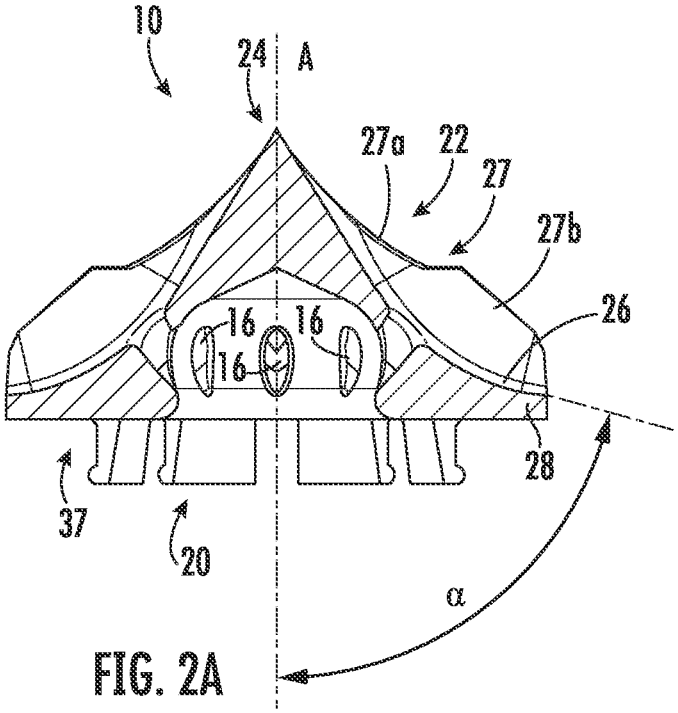

FIG. 2*a* depicts a sectional view through an exemplary embodiment of a deflector element.

Figure 2B:
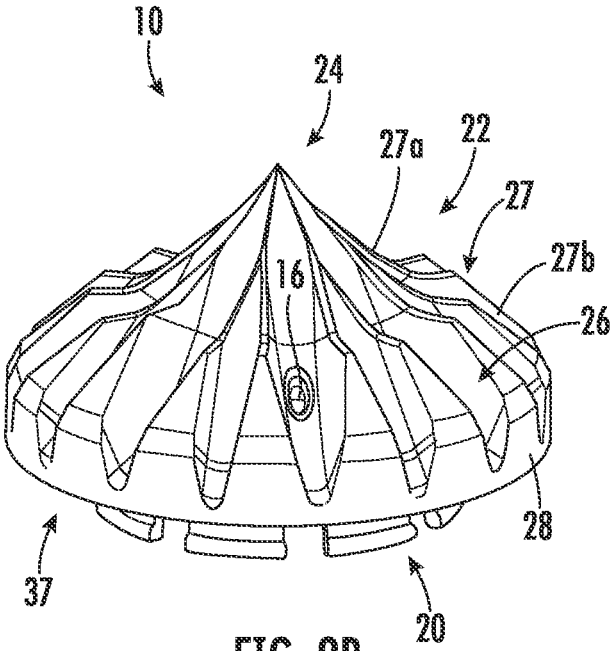

FIG. 2*b* depicts a perspective view of the deflector element shown in FIG. 2*a*.

Figure 3A:
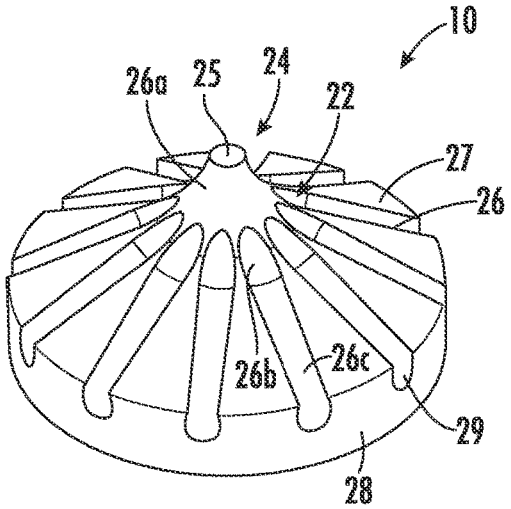

FIG. 3*a* depicts a perspective view of another exemplary embodiment of a deflector element.

Figure 3B:
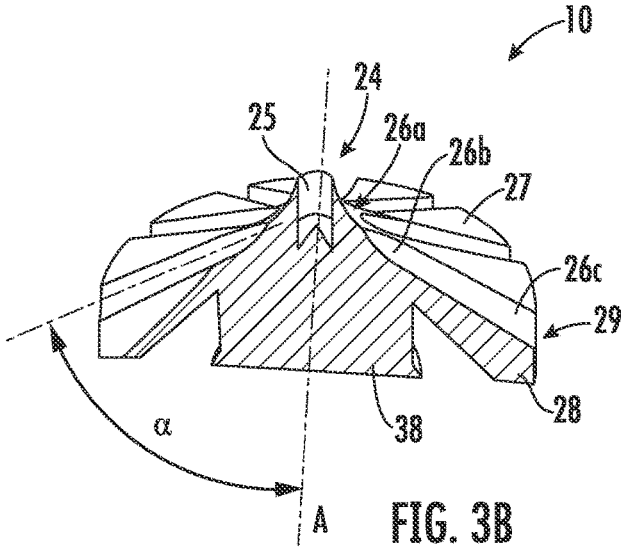
Figure 3C:
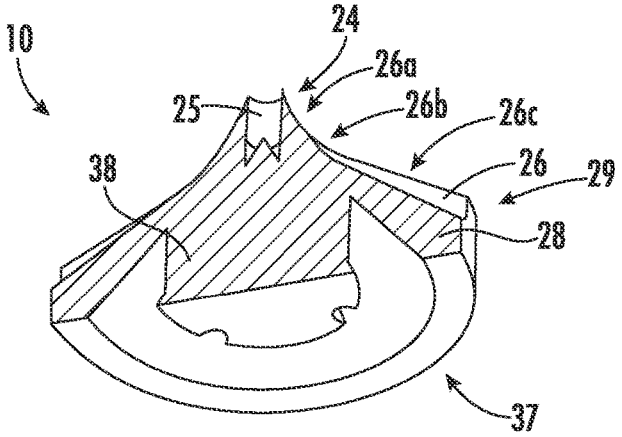
Figure 3D:
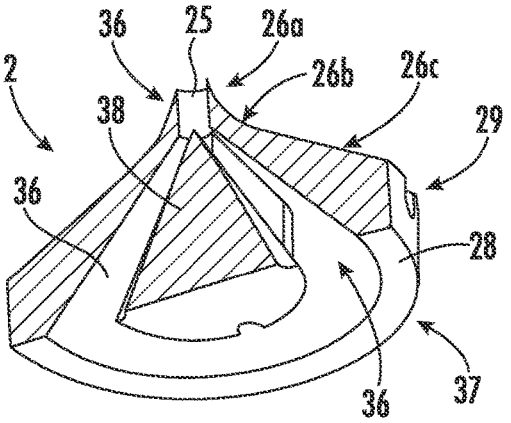

FIGS. 3*b* to 3*d* depict different perspective sectional views of the deflector element shown in FIG. 3*a*.

Figure 4A:
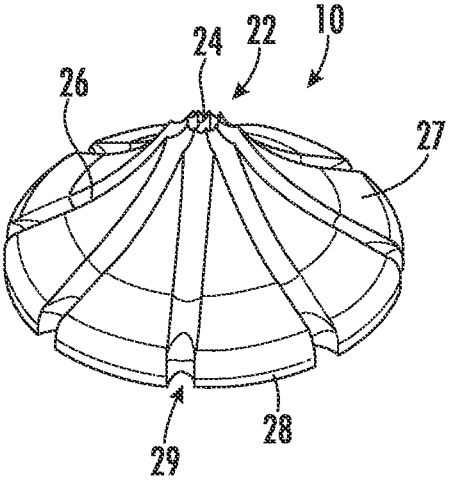

FIG. 4*a* depicts a perspective view of yet another exemplary embodiment of a deflector element.

Figure 4B:
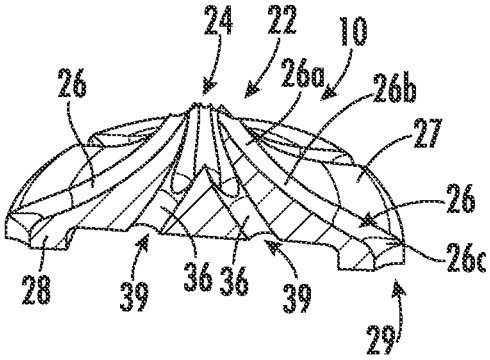
Figure 4C:
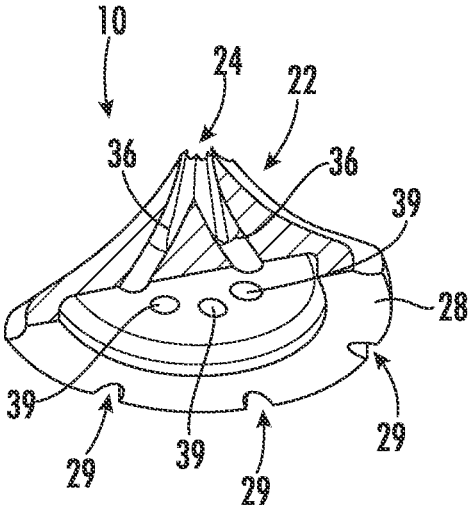

FIGS. 4*b* and 4*c* depict different perspective sectional views of the deflector element shown in FIG. 4*a*.

FIG. 1 depicts a perspective sectional view of the water mist nozzle 2 according to an exemplary embodiment of the invention.

The water mist nozzle 2 shown in FIG. 1 comprises a nozzle head 4 which is provided with a connection portion 5 to be connected to a conduit (not shown) supplying a fire extinguishing fluid, in particular water.

The opposing end of the nozzle head 4, i.e. the bottom end in FIG. 1, is provided with a discharge nozzle 6, which is configured to eject a jet 12 of the fire extinguishing fluid provided by the conduit.

A stationary deflector element 10 is arranged opposite to the discharge nozzle 6 such that the fluid jet 12 exiting the discharge nozzle 6 impinges onto the deflector element 10 and is distributed by the stationary element 10. The details of the stationary deflector element 10 will be discussed in more detail below with reference to the following figures.

The stationary deflector element 10 is held in position by a fastening structure 8 comprising two beams 9 extending basically parallel to the flowing direction of the fluid jet 12 when exiting the discharge nozzle 6 and a connection element 11, extending orthogonally between the ends of the rods 9 facing away from the discharge nozzle 6. On its upper side facing the discharge nozzle 6 the connection element 11 supports the stationary deflector element 10.

The deflector element 10 is fastened to the support element 11 by means of appropriate fastening elements, which are not visible in FIG. 1.

As can be seen from FIG. 1, the deflector element 10 causes lateral deflection of the fluid jet 12 exiting from the discharge nozzle 6. The spatial distribution of the deflected fluid in particular is defined by the geometrical details of the deflector element 10, which will be discussed more specifically with reference to the following figures.

FIG. 2*a* shows a sectional view through an exemplary embodiment of such a deflector element 10.

The deflector element 10 comprises a plurality of snap-on elements 20 on its lower side. The snap-on elements 20 are configured to engage with corresponding receiving elements (not shown) which are formed within the connecting element 11 and allow for securely fixing the deflector element 10 to the connecting element 11. Although snap-on elements 20 are shown in the Figures, other fastening elements such threads, screws, press-fittings, etc. may also be used.

The deflector element 10 further comprises a basically cylindrical base portion 28, which is rotational symmetric with respect to an axis A. A substantially conical upper portion 22 is formed on top of the base portion 28. At its top, the substantially conical upper portion 22 comprises an central peak 24. With respect to the substantially conical upper portion 22, the base portion 28 has a relatively low height.

In case of a sprinkler, the substantially conical upper portion 22 of the deflector element 10 may be at least partly formed by a set screw element, which is used for tightening the heat responsive element of the sprinkler.

As can be seen from FIG. 2*a*, the surface of the substantially conical upper portion 22 facing the nozzle head 4 and extending from the central peak 24 to the base portion 28 is not formed as a straight line, but with a varying slope. The slope in particular decreases from a steep slope in a region next to the central peak 24 to a much shallower slope at the outer periphery in a portion above the base portion 28.

As a result, the fluid from the fluid jet 12 exiting from the discharge nozzle 6 and impinging onto the central peak 24 of the deflector element is deflected while flowing along the surface of the substantially conical upper portion 22 and leaves the deflector element 10 at a spray angle $\alpha$, which is in the range of 25° to 80° with respect to axis A of the deflector element 10. The spray angle $\alpha$ in particular may be in the range of 30° to 75° with respect to axis A.

At least some of the flowpaths 26 comprise a flowpath opening 16 in their bottom allowing a portion of the fluid flowing along the flowpath to enter into an internal fluid channel or tunnel (not shown in FIGS. 2*a* and 2*b*). The fluid from said internal fluid channel(s) is dispensed from the underside 37 of the deflector element 10 generating an additional, more vertically oriented portion of the fluid distribution.

FIG. 2*b* shows a perspective view of the deflector element 10 shown in FIG. 2*a*. It in particular illustrates that the deflector element 10 comprises a plurality of flowpaths 26, which are formed by open fluid channels (grooves) extending radially from the central peak 24 to the outer periphery of the deflector element 10. The flowpaths 26 are separated from each other by intermediate sections 27, in particular fins, extending radially from the central peak 24 to the outer periphery of the deflector element 10, i.e. parallel to the flowpaths 26. As a result, each flowpath 26 is defined by a pair of adjacent intermediate sections 27. The flowpaths 26 and the intermediate sections 27 respectively extend along a straight line when viewed from above, i.e. in the direction of axis A In the embodiment show in FIGS. 2*a* and 2*b*, the intermediate sections 27 respectively comprise an inner portion 27*a* next to the central peak 24 and outer portion 27*b* next to the outer periphery of the deflector element 10. The outer portions 27*b* have a bigger height from the bottom of the flowpaths 26 than the inner portions 27*a*.

FIGS. 3*a* to 3*d* illustrate yet another exemplary embodiment of a deflector plate 10.

FIG. 3*a* is a perspective view; FIGS. 3*b* to 3*d* are perspective sectional views from different perspectives.

The deflector element 10 shown in FIGS. 3*a* to 3*d* comprises a base portion 28, having a circular periphery and a conical upper portion 22 which is formed on top of the base portion 18 and includes a central peak 24 at its top.

A plurality of fluid flowpaths 26 are formed as open fluid channels (grooves) between intermediate sections 27 within the upper surface of the conical upper portion 22. The fluid flowpaths 26 respectively extend from an upper end close to the central peak 24 radially to the outer periphery of the deflector element 10 and are respectively provided with radial openings 29 as their outer ends. The flowpaths 26 respectively extend along a straight line when viewed from above, i.e. in the direction of the vertical axis A The radial openings 29 allow fluid flowing along each flow path 26 to exit from the flow path 26 in a basically radial direction. Due to the slope of the flow paths 26 at their outer ends, the fluid will exit through the radial openings 29 in a slightly downwards oriented direction.

As can be seen most clearly from FIG. 3*b*, each of the flow paths 26 comprises a inner portion 26*a* close to the central peak 24 and an outer portion 26*c*, which extends towards the radially outer portion of the deflector element 10 and which is in fluid connection with a corresponding radial opening 29. The slope of the inner portions 26*a* is considerable steeper than the slope of the outer portions 26*c*.

The inner portion 26*a* and the outer portion 26*c* of each flow path 26 are fluidly connected by an intermediate portion 26*b* extending between the inner portion 26*a* and the outer portion 26*c*.

The intermediate portion 26*b* is formed with a variable slope, starting with a steep slope at its inner end, which is fluidly connected with the inner portion 26*a*, and a less steep (more shallow) slope at its outer end, which is fluidly connected to the outer portion 26*c* of the flow path 26.

As a result, the fluid from the discharge nozzle 6 impinging onto the central peak 24 is gently deflected by the varying slope of the flow path 26 to exit the flow path 26 via the radial openings 29. The fluid in particular leaves the flow paths 26 of the deflector element 10 at a spray angle $\alpha$ (see FIG. 3*b*), which is in the range of 25° to 80° with respect to axis A of the deflector element 10. The spray angle $\alpha$ in particular may be in the range of 30° to 75° with respect to the axis A.

FIGS. 3*c* and 3*d* depict the deflector element 10 in a perspective sectional view from below.

FIGS. 3*c* and 3*d* illustrate that the deflector element 10 comprises an internal structure including a top opening 25 at the central peak 24 and closed fluid channels or tunnels extending between the top opening 25 and the underside 37 of the deflector element 10 along the outer surface of a central cone 38, which is provided in a central inner portion of the deflector element 10.

As a result, the fluid from the fluid jet 12 exiting the discharge nozzle 6 and impinging onto the central peak 24 of the deflector element 10 is divided into two portions:

A first portion of the fluid is deflected by the surface of the conical portion 22 of the deflector element 10 and divided into a plurality of fluid streams. Each of the fluid streams respectively flows through one of the flowpaths 26 (channels) formed on the upper surface of the conical portion 22 of the deflector element 10 and leaves the deflector element 10 through one of the radial openings 29 provided at the outer peripheral ends of the fluid channels 26.

A second portion of the fluid from the fluid jet 12 enters through the top opening 25 provided at the upper peak of the deflector element 10 into the closed fluid channels or tunnels 36, which extend in a more vertical direction than the outer fluid channels 26 through the interior of the deflector element 10. Said second portion of fluid exits from the underside 37 of the deflector element 10 in a more vertically oriented direction than the first portion.

As a result, the deflector element 10 separates the fluid and allows for fluid distribution in two separate portions: A more laterally oriented first portion of the distributed fluid exiting from the radial openings 29 and a more vertically oriented second portion of the distributed fluid exiting from the underside 37 of the deflector element 10.

This combination of said two fluid portions results in very effective fire extinction.

FIGS. 4*a* to 4*c* illustrate yet another exemplary embodiment of the deflector element 10. FIG. 4*a* shows a perspective view of the deflector element 10 from above, FIG. 4*b* shows a perspective sectional view from above, and FIG. 4*c* shows a sectional perspective view from below.

The basic configuration of the deflector element 10 is similar to the deflector element 10, which has been shown and discussed before with reference to FIGS. 3*a* to 3*d*.

The deflector element 10 in particular also comprises a basically cylindrical base portion 28 and a substantially conical upper portion 22, which is arranged on top of the base portion 28 and comprises a plurality of flowpaths 26 (open fluid channels) radially extending between intermediate sections 27 formed on the upper surface of the substantially conical upper portion 22.

The height of the base portion 28 with respect to the height of the upper portion 22, however, is considerably reduced in comparison to the previously discussed embodiment. Furthermore, the radial openings 29 provided at the radial outer ends of the flow paths 26 are also open to the underside 27 of the deflector element 10 allowing the fluid to exit from the flow paths 26 in a more vertical direction.

In the embodiment shown in FIGS. 4*a* to 4*c*, the slope of the flow paths 26 varies continuously over the whole length of the flow paths 26 comprising a relatively step inner portion 26*a* close to the center, a more shallow intermediate portion, and a steeper outer portion at the very outer end next to the radial opening 29.

Similar to the second embodiment, which has been discussed with reference to FIGS. 3*a*-3*d*, the central peak 24 of the deflector element 10 is provided with a top opening 25 allowing a portion of the fluid from the fluid jet 12 impinging onto the deflector element 10 to enter into closed fluid channels or tunnels 36, which are formed inside the deflector element 10.

The opposing lower ends of said closed fluid channels or tunnels 36 are respectively provided with underside openings 39 allowing the fluid, which has entered through the top opening 25 to exit through the underside 37 of the deflector element 10 in a basically vertical direction.

As a result, the fluid jet 12 exiting from the discharge nozzle 6 and impinging onto the deflector element 10 is divided into a more laterally flowing first portion exiting from the deflector element 10 via the radial openings 29, and a more vertically oriented portion exiting from the underside 37 of the deflector element 10 via the underside openings 39.

This combination of said two fluid portions results in a very effective fire extinction.

A number of optional features are set out in the following. These features may be realized in particular embodiments, alone or in combination with any of the other features.

In one embodiment, the portions of decreasing slope are formed by upstream flowpath portions adjacent the central peak, with the slope being measured with respect to a horizontal plane. Concentrating the portions of decreasing slope at the central peak allows for an easy production of the deflector.

In one embodiment, the flowpaths have a decreasing slope over their entire length, i.e. the slope of the bottom of the flowpaths decreases, seen in a flow direction from a radial position close to the central peak towards the outer periphery, wherein the slope is measured with respect to a horizontal plane. The slope in particular may be steep close to the central peak and change to a shallower slope in an area close at the outer periphery. Such a structure results in a very effective deflection of the fluid, in particular, the loss of energy, which would be caused be sharp bends in the flowpaths, is minimized.

In one embodiment, at least some of the flowpaths are formed as open fluid channels or grooves in the substantially conical upper portion of the stationary deflector element. Open fluid channels and grooves are easy to produce, e.g. by machining.

In one embodiment, at least some of the flowpaths are formed as closed fluid channels or tunnels extending through the substantially conical upper portion of the stationary deflector element. Closed fluid channels or tunnels formed within the stationary deflector element allow for additional/alternative flowpaths, which may result in an even further optimized fluid distribution.

In one embodiment, the stationary deflector element may be formed at least partly comprising a multi-layer structure. This may include 3D printing, e.g. laser sintering from metal powder. When formed comprising a multi-layer structure, the deflector geometry is not limited to plate like geometries. Multi-layer structures allow for an easy manufacturing of geometries which cannot be formed with traditional methods allowing the fluid to be distributed by grooves, internal flow paths and holes, respectively provided at suitable locations within the deflector element.

In one embodiment, at least some of the flowpaths start as a single flowpath close to the central peak and branch into at least two partial outer flowpath portions towards the outer periphery. Branching the flowpaths allows to provide additional flowpaths, which may help to optimize the fluid distribution.

In one embodiment, the deflector element comprises a plurality of radially extending intermediate sections or fins separating adjacent flowpaths from each other. The radially extending intermediate sections or fins in particular may have a higher height than the flowpaths, measured with respect to the bottom of the flowpaths. Intermediate sections or radially extending fins allow separating the flowpaths from each other which results in a very effective distribution of the liquid.

In one embodiment, the angle of the slope of the flowpaths at a radial position close to the central peak is between 10° and 30°, in particular between 15° and 25°, and more in particular around 20°, with respect to a vertical axis extending between the discharge nozzle and the central peak. A slope of the flowpaths close to the central peak within these angular ranges has been found to provide an advantageous fluid distribution, which is very efficient for fire extinction.

In one embodiment, the angle of the slope of the flowpaths at the outer periphery of the deflector element is between 25° and 80°, in particular between 30° and 75°, with respect to an axis extending between the discharge nozzle and the central peak. A slope of the flowpaths at the outer periphery inside these angle ranges has been found to provide advantageous fluid distribution, which is very efficient for fire extinction.

In one embodiment, the width of the flowpaths increases from a radial position close to the central peak towards the outer periphery. Flowpaths formed with such an increasing width have been found to provide an advantageous fluid distribution, which is very efficient for fire extinction.

In one embodiment, the flowpaths, when projected onto a plane extending perpendicularly to a central axis of the conical upper portion extend in a straight, non-curved line from the central peak towards the outer periphery of the deflector element. Such straight extending flowpaths are easy to produce, e.g. by machining, and provide advantageous fluid distribution, which is very efficient for fire extinction.

In one embodiment, the deflector element comprises 4 to 24, in particular 8 to 20, more particularly 12 to 16 flowpaths. Such a configuration provides advantageous fluid distribution, which is very efficient for fire extinction.

In one embodiment, the deflector element is rotationally symmetric with respect to a vertical axis extending through the central peak or, seen in a built-in position, between the discharge nozzle and the central peak. A rotationally symmetric deflector element may be produced easily, e.g. using a turning machine.

In one embodiment, the base portion of the body is configured to be fastened to a support structure of a water mist nozzle. The base portion of the body in particular comprises fastening members, e.g. male or female snap-in fastening members, threads, screws or press-fittings, etc. at the base portion extending into a direction opposite the central peak, and the support structure comprises corresponding fastening members which are configured for engaging with the fastening members of the base portion. This allows for an easy, fast and reliable fastening of the deflector element at the water mist nozzle.

In one embodiment, the stationary deflector element is arranged in a distance of 1 cm to 10 cm, in particular of 1.5 cm to 5.5 cm, and more in particular of 1.6 cm to 3.5 cm from the opening of the discharge nozzle. A distance in this range has been found to yield in a compact water mist nozzle providing advantageous fluid distribution, which is very efficient for fire extinction.

In one embodiment, the water mist nozzle comprises two beams extending from an outer side of the discharge nozzle in a direction substantially parallel to the supply direction of the fluid jet, and a connection element between the lower ends of the two beams, wherein the deflector element is positioned at the connection element. This provides a reliable, rigid and solid structure for permanently holding the deflector element in the desired position with respect to the discharge nozzle.

In one embodiment, at least one of the flowpaths comprises a flowpath opening in its bottom allowing a portion of the fluid flowing along the flowpath to enter into an internal fluid channel or tunnel, which is formed inside the deflector element. Said fluid is dispensed from the underside of the deflector element for generating an additional, more vertically oriented portion of the distributed fluid.

Embodiments of the invention further include a sprinkler head comprising a water mist nozzle according to an exemplary embodiment of the invention and a heat responsive valve mechanism blocking the fluid jet/flow of water out of the discharge nozzle. The heat responsive mechanism is configured for unblocking the fluid jet/flow of water in case the ambient temperature exceeds a predetermined limit. In sprinkler systems the pipes are typically filled with a fluid extinguishing liquid throughout, i.e. up until the sprinkler. The fluid, in particular water, is pressurized and generates a water mist spilling out of the water mist nozzle when the heat responsive valve mechanism opens due to an increase of temperature in the environment of the sprinkler head.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the claims.

REFERENCES

2 water mist nozzle
4 nozzle head
5 connection portion
6 discharge nozzle
8 fastening structure
9 rod
10 deflector element
11 connection element
12 fluid jet
16 flowpath openings
20 snap-on elements
22 upper portion of the deflector element
24 upper peak
25 top opening
26 flowpath/open fluid channel
**26*a*** inner portion of the flowpath
**26*a*** intermediate portion of the flowpath
**26*c*** outer portion of the flowpath
27 intermediate section
**27*a*** inner portion of the intermediate section
**27*b*** outer portion of the intermediate section
28 base portion of the deflector element
29 radial opening
36 closed fluid channel/tunnel
37 underside of the deflector element
38 central cone
39 underside opening
A axis

The invention claimed is:

1. A water mist nozzle (2) for a fire suppression system, comprising a nozzle head (4) including a discharge nozzle (6) for supplying a fluid jet (12); a support structure (8); and a stationary deflector element (10) which is fastened to the support structure (8) and comprises a body with a substantially round outer periphery having a base portion (28) and a substantially conical upper portion (22) with a central peak (24); wherein the substantially conical upper portion (22) provides a plurality of flow paths (26), the flow paths (26) extending substantially radially in a direction towards the outer periphery of the deflector element (10), the flow paths (26) having at least one portion (**26*a*, 26*b*, 26*c*) in which the slope of a bottom of the flow paths (26) decreases along a flow direction towards the outer periphery; wherein the stationary deflector element (10) is fastened to the support structure (8) such that the central peak (24) of the substantially conical upper portion (22) of the stationary deflector element (10) faces the discharge nozzle (6) and that a fluid jet (12) exiting the discharge nozzle (6) impinges onto the central peak (24) and is distributed to the environment, substantially in a lateral direction, through the plurality of flow paths (26); wherein the flow paths (26), when projected onto a plane, which is oriented perpendicularly to a central axis (A) extending between the discharge nozzle (6) and the central peak (24), extend in a straight, non-curved line from the central peak (24) towards the outer periphery of the deflector element (10); wherein at least some of the flow paths (26) are formed as open fluid channels or grooves (26) on the substantially conical upper portion (22) of the stationary deflector element (10) and at least one discrete flow path opening (16) is formed in the bottom of a plurality of the flow paths (26) allowing a portion of the fluid flowing along the at least one flow path (26) to enter into an internal fluid channel or tunnel and being dispensed downwards from a concave surface at an underside (37) of the deflector element (10**).

2. The water mist nozzle (2) according to claim 1, wherein the at least one portion (26*a*, 26*b*, 26*c*) of decreasing slope is formed by upper portions (26*a*, 26*b*) of the flow path (26) adjacent the central peak (24).

3. The water mist nozzle (2) according to claim 2, wherein the entire flow paths (26) have a decreasing slope, such that the slope of the bottom of the flow paths (26) decreases, seen in the flow direction from a radial position close to the central peak (24) towards the outer periphery.

4. The water mist nozzle (2) according to claim 1, wherein the deflector element (10) comprises a plurality of intermediate sections (27) or radially extending fins separating adjacent flow paths (26) from each other.

5. The water mist nozzle (2) according to claim 1, wherein at least some of the flow paths (26) are formed as closed fluid channels or tunnels (36) within the substantially conical upper portion (22) of the stationary deflector element (10).

6. The water mist nozzle (2) according to claim 1, wherein at least some of the flow paths (26) branch into two partial outer flow path portions.

7. The water mist nozzle (2) according to claim 1, wherein a width of the flow paths (26) increases from a radial position close to the central peak (24) towards the outer periphery.

8. The water mist nozzle (2) according to claim 1, wherein an angle (a) of the slope of the flow paths (26) at the outer periphery of the deflector element (10) is between 25° and 80° with respect to the central axis (A) extending between the discharge nozzle (6) and the central peak (24).

9. The water mist nozzle (2) according to claim 1, wherein an angle ((3) of the slope of the flow paths (26) at a radial position close to the central peak (24) is between 10° and 30°, with respect to the central axis (A) extending between the discharge nozzle (6) and the central peak (24).

10. The water mist nozzle (2) according to claim 1, comprising 4 to 24 flow paths (26).

11. The water mist nozzle (2) according to claim 1, wherein a shape of the deflector element (10) is rotationally symmetric with respect to the central axis (A) extending between the discharge nozzle (6) and the central peak (24).

12. The water mist nozzle (2) according to claim 1, wherein the stationary deflector element (10) is formed at least partly by a multi-layer structure.

13. The water mist nozzle (2) according to claim 1, wherein the base portion (28) of the body is configured to be fastened to the support structure (8) of the water mist nozzle (2).

14. The water mist nozzle (2) according to claim 13, wherein the base portion (28) of the body comprises at least one fastening member (20), particularly a screw or thread formed at the base portion (28) and extending into a direction opposite the central peak (24), and wherein the support structure (8) comprises at least one fastening member, particularly a screw or thread engaging with at least one corresponding fastening member of the stationary deflector element (10).

15. The water mist nozzle (2) according to claim 1, wherein the support structure includes two beams (9) extending from an outer side of the discharge nozzle (6) in a direction which is 0° to 45° with respect to the central axis (A) extending between the discharge nozzle (6) and the central peak (24) of the substantially conical upper portion (22) of the deflector element (10).

16. The water mist nozzle (2) according to claim 1, wherein the stationary deflector element (10) is arranged at a distance of 1 cm to 10 cm from the discharge nozzle (6).

17. The water mist nozzle (2) according to claim 1 further comprising:

a heat responsive valve mechanism blocking the fluid jet (12) from spilling out of the discharge nozzle (6);

wherein the heat responsive mechanism is configured for unblocking the fluid jet (12) in case the ambient temperature exceeds a predetermined limit.

18. The water mist nozzle (2) according to claim 8, wherein the angle (a) of the slope of the flow paths (26) at the outer periphery of the deflector element (10) is between 30° and 75° with respect to the central axis (A) extending between the discharge nozzle (6) and the central peak (24).

19. The water mist nozzle (2) according to claim 9, wherein the angle ((3) of the slope of the flow paths (26) at the first radial position is between 15° and 25° with respect to the central axis (A) extending between the discharge nozzle (6) and the central peak (24).

20. The water mist nozzle according to claim 1, wherein the at least one discrete flow path opening has an elongated cross section having a major axis aligned with a length of a respective flow path.

* * * * *